US007244099B2

(12) United States Patent
Yamasaki

(10) Patent No.: US 7,244,099 B2
(45) Date of Patent: Jul. 17, 2007

(54) MULTI-VANE CENTRIFUGAL FAN

(75) Inventor: Takahiro Yamasaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/554,710

(22) PCT Filed: Apr. 26, 2004

(86) PCT No.: PCT/JP2004/006019

§ 371 (c)(1),
(2), (4) Date: Oct. 27, 2005

(87) PCT Pub. No.: WO2004/097225

PCT Pub. Date: Nov. 11, 2004

(65) Prior Publication Data

US 2006/0198729 A1 Sep. 7, 2006

(30) Foreign Application Priority Data

May 1, 2003 (JP) ..... 2003-126122

(51) Int. Cl.
*F01D 11/02* (2006.01)

(52) U.S. Cl. ..... 415/173.6; 415/206

(58) Field of Classification Search ..... 415/171.1, 415/172.1, 173.1, 173.6, 203, 204, 206; 416/178, 416/185, 186 R, 187, 188, 223 B, 228, 235, 416/237, 242

See application file for complete search history.

(56) References Cited

U.S. PATENT DOCUMENTS 3,260,443 A * 7/1966 Garnett et al. ..... 416/186 R
3,692,428 A * 9/1972 Bubb et al. ..... 416/187
3,846,043 A * 11/1974 Wolbrink et al. ..... 416/186 R
4,432,694 A 2/1984 Kuroda et al.
5,855,469 A * 1/1999 McConnell ..... 415/171.1
6,092,988 A * 7/2000 Botros ..... 415/206
6,478,538 B2 * 11/2002 Kim ..... 415/204
6,558,120 B2 * 5/2003 Kim et al. ..... 416/186 R
2003/0077174 A1 * 4/2003 Kim ..... 416/186 R

FOREIGN PATENT DOCUMENTS

JP 53-89607 12/1875
JP 56-118593 9/1981
JP 57-51193 3/1982
JP 57-127900 U 8/1982
JP 57-157798 U 10/1982
JP 59-182698 10/1984
JP 04-143525 5/1992
JP 07-27097 A * 1/1995

* cited by examiner

*Primary Examiner*—Justine R. Yu
*Assistant Examiner*—Devin Hanan
(74) *Attorney, Agent, or Firm*—Global IP Counselors, LLP

(57) ABSTRACT

A multi-vane centrifugal fan has a fan housing and an impeller. The impeller includes a plurality of vanes arranged with a prescribed spacing in the circumferential direction and fixed to a hub rotatably driven around a shaft core. The impeller further includes an annular member for reinforcement that is provided on a side of the vanes opposite the hub. The fan housing has a bell mouth with a recessed part that is provided around a circumference of an air suction port of the fan housing. The recessed part has air suction port side end parts positioned on the side of the vanes opposite the hub and rotatably inserted in the recessed part without having a shroud.

10 Claims, 9 Drawing Sheets

MULTI-VANE CENTRIFUGAL FAN

CROSS-REFERENCE TO RELATED APPLICATIONS

This U.S. National stage application claims priority under 35 U.S.C. §119(a) to Japanese Patent Application Nos. 2003-126122, filed in Japan on May 1, 2003, and 2004-125427, filed in Japan on Apr. 21, 2004, the entire contents of which are hereby incorporated by reference.

FIELD OF THE INVENTION

The invention of the present application relates to the structure of a multi-vane centrifugal fan.

RELATED ART

Among multi-vane centrifugal fans, there is one as depicted in FIG. 7 through FIG. 9, for example. This multi-vane centrifugal fan comprises an impeller 103 and a fan housing 104.

The impeller 103 comprises a hub 131, numerous vanes 133, 133, . . . and an annular member 132. With the impeller 103, one end 133*c* of the numerous vanes 133, 133, . . . are fixed to the hub 131 capable of rotating about a shaft core, and are provided and arranged spaced apart by a predetermined spacing in the circumferential direction. In addition, with the impeller 103, the annular member 132, which is for reinforcement, is mated and fixed to the outer circumference of the end parts 133 d on the opposite side of the numerous vanes 133, 133, . . . This impeller 103 is housed inside the fan housing 104.

An air suction port 105 is formed in the fan housing 104, surrounded by a curved part 105*a* that is arcuate in the air suction direction, as depicted in FIG. 7. In addition, the fan housing 104 has a scroll structure having an air blow out port 141 in the centrifugal direction. The impeller 103 is housed and supported inside this fan housing 104 via a motor shaft 102*a* of an impeller drive motor 102. When the motor shaft 102*a* is rotatably driven by the impeller drive motor 102, the air sucked in from the air suction port 105 is blown out into a vortex chamber 140 in the fan housing 104 via vane passageways between the vanes 133, 133, . . . , and the air is subsequently blown out from the air blow out port 141 to the outside, as depicted by the arrows of the virtual lines (the chain double-dashed line) in FIG. 7.

The abovementioned type of multi-vane centrifugal fan comprises an annular bell mouth that includes the curved part 105*a* formed around the circumference of the air suction port 105 of the fan housing 104, but the impeller 103 has a shroudless structure that does not comprise a member (a so-called shroud) having a surface opposing this bell mouth. A sirocco fan having such a shroudless structure is disclosed in Japanese Unexamined Utility Model Application Publication No. S59-182698 (pp. 2-6, FIG. 1 through FIG. 5).

If such a shroudless structure is adopted, then it is possible to reduce the number of parts in proportion to the absence of a shroud and to thereby reduce the weight of the multi-vane centrifugal fan, compared with the case wherein a structure having a shroud is adopted, as disclosed in Japanese Examined Published Patent Application No. H07-27097.

SUMMARY OF THE INVENTION

In the case of the multi-vane centrifugal fan having a shroudless structure, a vane width W1 of the vane 133 is fixed from an air inlet side edge part 133*a* (the portion on the shaft core side) to an air outlet side edge part 133*b* (the portion on the side opposite the shaft core), as depicted in FIG. 9, for example. In addition, the shape of the end part 133*d* on the air suction port 105 side is also flat, the same as the portion on the hub 131 side. Accordingly, the sealing performance is low in the vicinity of the air suction port 105. Consequently, as depicted in FIG. 7, for example, a reverse flow region R is generated in the vicinity of the end part 133*d* (refer to FIG. 9) on the air suction port 105 side of the air outlet side edge part 133*b* of the vane 133, and there is consequently a problem of increased aerodynamic noise because of the increased relative velocity of the blown out air flow in the vicinity of the air outlet side edge part 133*b* of the vane 133.

In addition, turbulence due to interference is generated in the gap between the inner surface of the arcuate curved part 105*a* of the air suction port 105 and the impeller 103. This is also a source of aerodynamic noise.

Aspects of the present invention solve such problems, with a shroudless multi-vane centrifugal fan as discussed above, wherein the bell mouth having a recessed part of a prescribed depth is provided around the circumference of the air suction port, and the air suction port side end part of each vane is sealably shaped corresponding to the cross sectional shape of the recessed part of the bell mouth. Thereby, a multi-vane centrifugal fan is provided that reliably solves the problems discussed above, and reduces running noise as much as possible.

A multi-vane centrifugal fan according to one aspect of the present invention comprises an impeller, and a fan housing. The impeller comprises a hub, numerous vanes, and an annular member for reinforcement. The hub is rotatably driven around a shaft core. The numerous vanes are provided and arranged with a prescribed spacing in the circumferential direction of the hub, and are fixed to the hub. The annular member is provided on the side of the numerous vanes opposite the hub. The fan housing rotatably houses the impeller therein. In addition, an air suction port is formed in the fan housing. Furthermore, a bell mouth having a recessed part of a prescribed depth is provided in the fan housing around the circumference of the air suction port. Further, air suction port side end parts (portions positioned on the side opposite the hub) of the numerous vanes are rotatably inserted inside the recessed part of the bell mouth, without having a shroud.

Here, sealing performance increases because a bell mouth having a recessed part is provided, and the air suction port side end part of each vane is inserted into the recessed part of the bell mouth. Namely, a reverse flow of air is suppressed in the vicinity of the air suction port side end part of the air outlet side portion of the vane, and the flow speed distribution becomes nearly uniform over the entire area on the air outlet side of the impeller. Thereby, aerodynamic noise is reduced.

In addition, if the gap between the bell mouth and the air suction port side end part of each vane is reduced, interference decreases, and the resulting aerodynamic noise also decreases.

In addition, if the gap between the bell mouth and the air suction port side end part of each vane is reduced, it is preferable to make the shape of the air suction port side end part of each vane a sealable shape that corresponds to the cross sectional shape of the recessed part of the bell mouth.

In addition, assuming a vane, for example, with a conventional constitution having a fixed vane width, if the portion inserted in the recessed part of the bell mouth is formed in the vane by cutting out a part of the air suction port side end part of that vane, then the weight of the vane decreases by just that portion, the load on the motor decreases, and the breaking strength of the vane increases.

In addition, it is preferable to make the vane width, which is the length of the numerous vanes in the shaft core direction, so that the air outlet side is made smaller than the air inlet side, and so that it decreases with a prescribed variation pattern from the air inlet side to the air outlet side. In so doing, a more favorable sealing performance can be achieved in the vicinity of the bell mouth.

In addition, the prescribed variation pattern wherein the vane width is reduced from the air inlet side to the air outlet side is preferably: a pattern wherein the shape of the air suction port side end part varies in a curved shape from the air inlet side to the air outlet side; a pattern wherein the shape of the air suction port side end part varies in an arcuate shape having a prescribed curvature from the air inlet side to the air outlet side; or a linear variation pattern wherein the shape of the air suction port side end part varies linearly from the air inlet side to the air outlet side.

By adopting such a variation pattern, the air sucked in from the air suction port can be blown out more smoothly in the centrifugal direction because the vane width of the air outlet side portion is reduced while making the vane width of the air inlet side portion of each vane large.

In addition, it is preferable to provide the annular member positioned at the portion that is the air outlet side of the numerous vanes where the vane width that is the length of the numerous vanes in the shaft core direction is smallest, and that is the air suction port side. According to such a constitution, if the air suction port is disposed toward the upper side, the center of gravity of the impeller shifts downward, and the rotational state thereof becomes more stable.

A multi-vane centrifugal fan according to another aspect of the present invention comprises an impeller and a fan housing. The impeller comprises a hub, numerous vanes, and an annular member for reinforcement. The hub is rotatably driven around a shaft core. The numerous vanes are provided and arranged with a prescribed spacing in the circumferential direction of the hub, and are fixed to the hub. The annular member is disposed on the outer side in the radial direction of the numerous vanes, and is integrated with the end parts on the side of the numerous vanes opposite the hub. The fan housing rotatably houses the impeller therein. The spaces interposed between adjacent vanes of the impeller are fully open in the shaft core direction and in the direction of the side opposite the hub. The air suction port is formed in the fan housing, and a bell mouth having a recessed part of a prescribed depth is provided in the fan housing around the circumference of the air suction port. Further, air suction port side end parts positioned on the side of the numerous vanes opposite the hub are inserted inside the recessed part of the bell mouth.

Here, sealing performance increases because a bell mouth having a recessed part is provided, and the air suction port side end part of each vane is inserted into the recessed part of the bell mouth. Namely, a reverse flow of air is suppressed in the vicinity of the air suction port side end part of the air outlet side portion of the vane, and the flow speed distribution becomes nearly uniform over the entire area on the air outlet side of the impeller. Thereby, aerodynamic noise is reduced.

In addition, because the annular member is disposed on the outer side of the vanes in the radial direction, and because the spaces interposed by adjacent vanes are completely open in the shaft core direction and in the direction of the side opposite the hub, the annular member and the vanes can be easily formed by integral molding.

DETAILED DESCRIPTION OF THE PREFERRED EMBODIMENTS

First Embodiment

Figure 1:
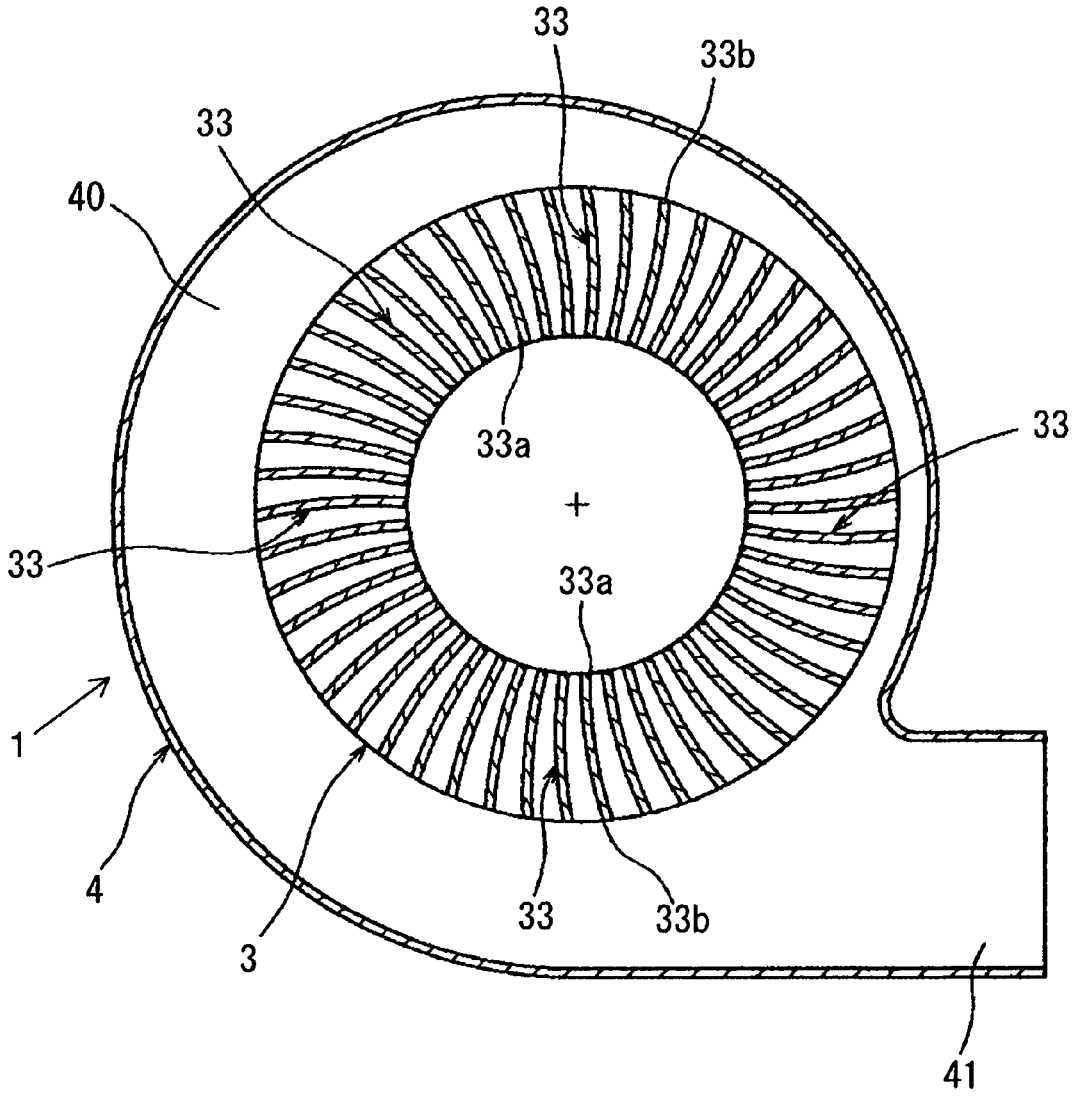
FIG. 1 is a horizontal cross sectional view that depicts the constitution of a multi-vane centrifugal fan according to the first embodiment of the invention of the present application.
Figure 2:
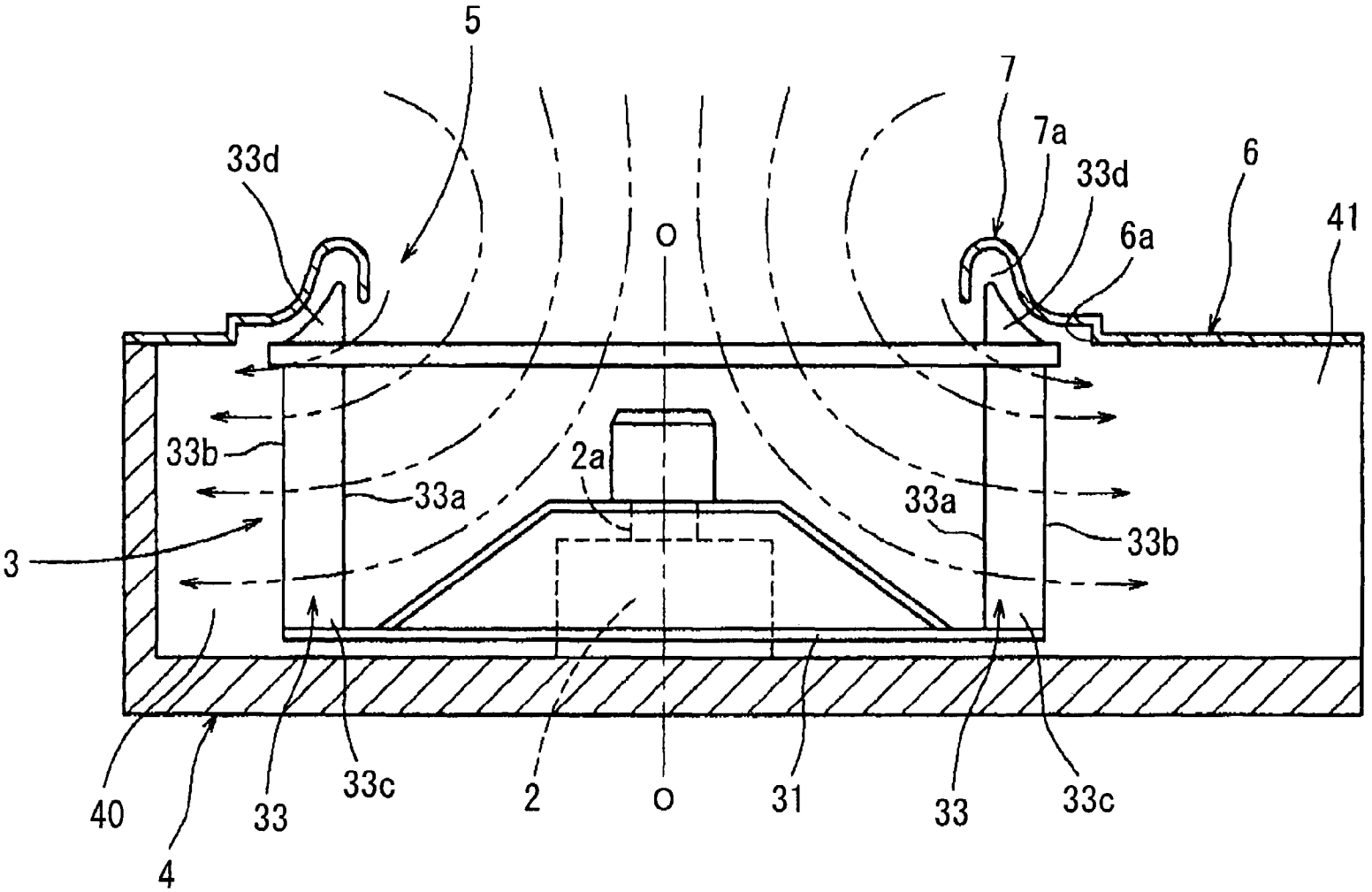
FIG. 2 is a longitudinal cross sectional view that depicts the constitution of the multi-vane centrifugal fan.
Figure 3:
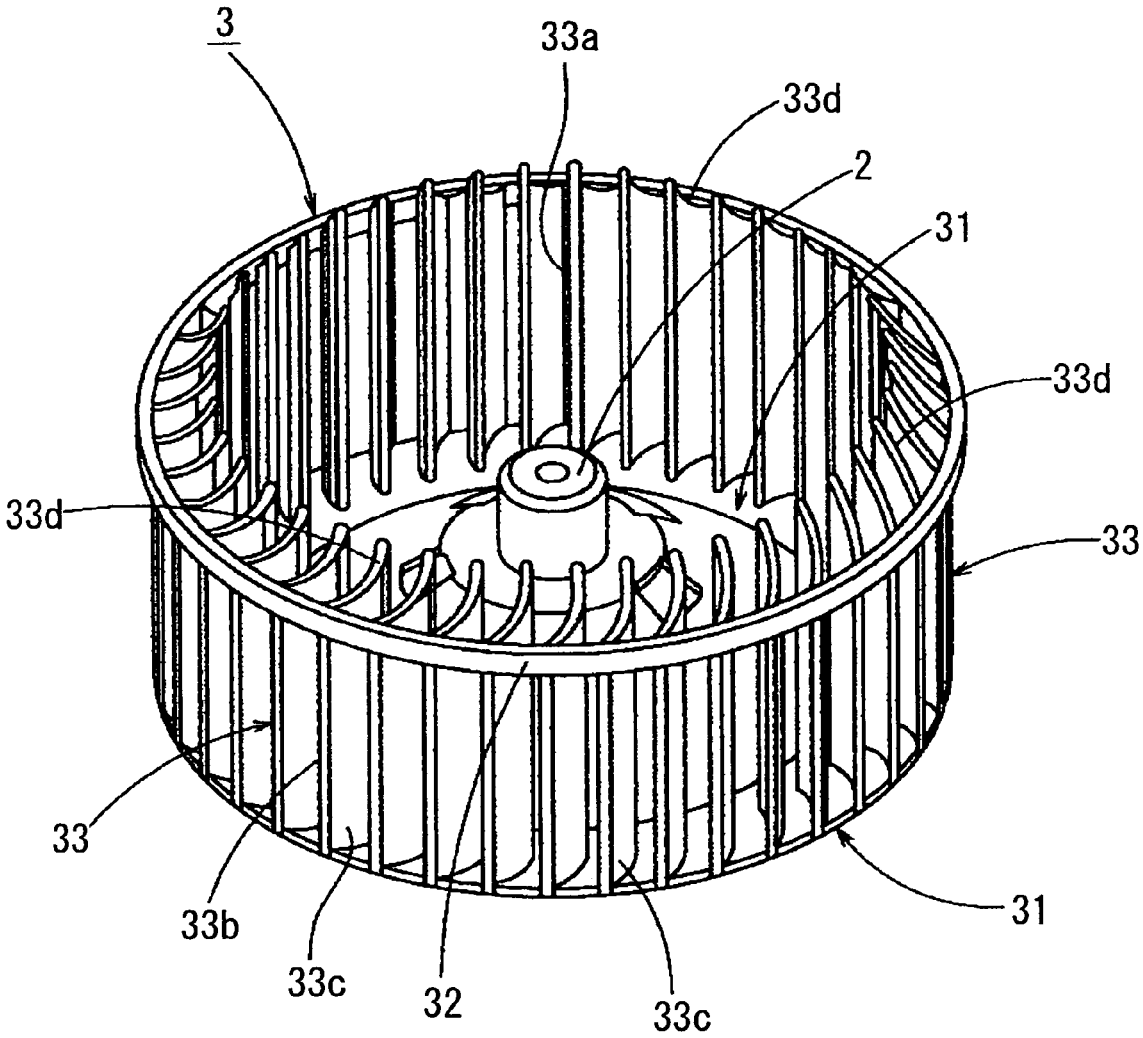
FIG. 3 is an oblique view that depicts the constitution of an impeller of the multi-vane centrifugal fan.

FIG. 1 through FIG. 3 depict the constitution of the multi-vane centrifugal fan according to the first embodiment of the invention of the present application. This multi-vane centrifugal fan 1 comprises an impeller drive motor 2, an impeller 3, and a fan housing 4, as depicted in FIG. 1 and FIG. 2. The impeller 3 is supported by a rotary shaft 2*a* of the impeller drive motor 2, and is rotatably driven by the impeller drive motor 2. The fan housing 4 rotatably houses the impeller 3 via the rotary shaft 2*a* of the impeller drive motor 2. This fan housing 4 comprises an air suction port forming plate 6, a bell mouth 7, and the like. The air suction port forming plate 6 forms an air suction port 5. The air suction port 5 is positioned concentric with a rotational axis O-O (shaft core) of the impeller 3, and has a size corresponding to the inner diameter of the impeller 3. The bell mouth 7 is positioned around the circumference of the air suction port 5.

The impeller 3 comprises a hub 31, numerous vanes 33, 33, . . . , and an annular member 32 for reinforcement. The disc shaped hub (main plate) 31 is rotatable about the rotational axis O-O. Each of the numerous vanes 33, 33, . . . has a prescribed vane width/vane outer diameter ratio. The numerous vanes 33, 33, . . . are each fixed to the hub 31 and provided and arranged in the circumferential direction with a prescribed vane spacing and at a prescribed vane angle corresponding to the rotational direction of the hub 31. The annular member 32, which is for reinforcement, is mated and fixed to, or integrally formed with, the outer circumferential portion of each of the vanes 33 on the side opposite the hub 31 (the air suction port 5 side). Furthermore, the annular member 32 is disposed on the outer side in the radial direction of the numerous vanes 33, 33, . . . .

Furthermore, in the case of the impeller 3 of the first embodiment, an end part 33*c* of each of the vanes 33, 33, . . . on the hub 31 side is flat, and is provided and arranged in an orthogonal state and fixed to the surface of the hub 31. However, an air suction port side end part (end part on the air suction port 5 side) 33*d* of each of the vanes 33, 33, . . . on the side opposite the hub 31 is curved. As depicted in detail in FIG. 4, the vane width of an air inlet side edge part (end part on the rotational axis O-O side) 33*a* of each of the vanes 33, 33, . . . is the vane width W1, which is identical to the vane width of the vane of the conventional impeller discussed earlier (refer to FIG. 9). In contrast, the air outlet side edge part (end part on the side opposite the rotational axis O-O) 33*b* of each of the vanes 33, 33, . . . has a vane width W2 smaller than the vane width W1 by just a prescribed dimension W3. Furthermore, the air outlet side (the side opposite the rotational axis O-O side) is notched so that the shape of the end of each of the vanes 33, 33, . . . forms an arcuate shape of a prescribed curvature that is inwardly recessed. Thus, each of the vanes 33, 33, . . . is constituted so that the vane width becomes smaller in an arcuate pattern of a prescribed curvature from the air inlet side edge part 33*a* to the air outlet side edge part 33*b*.

As will be discussed later, this arcuate shape is formed corresponding to the cross sectional shape of a recessed part 7*a*, having a prescribed depth, of the bell mouth 7 provided around the circumference of the air suction port 5. In a state wherein the air suction port side end part 33*d* of each of the vanes 33, 33, . . . is loosely fitted inside the recessed part 7*a* as depicted in FIG. 2, any one of a front edge face part A, a tip face part B, or an arcuate end face part C of each air suction port side end part 33*d* has a spacing (clearance) to the inner circumferential surface of the recessed part 7*a* of the bell mouth 7 that is smaller than other portions. Thereby, the generation of the reverse flow region R as discussed earlier is suppressed, interference and leakage flow generated due to the presence of a gap between the air suction port side end part 33*d* of the vane 33 and the inner circumferential surface of the recessed part 7*a* of the bell mouth 7 are suppressed, thereby suppressing turbulence due to that leakage flow and interference, and achieving a reduction in ventilation noise.

Figure 4:
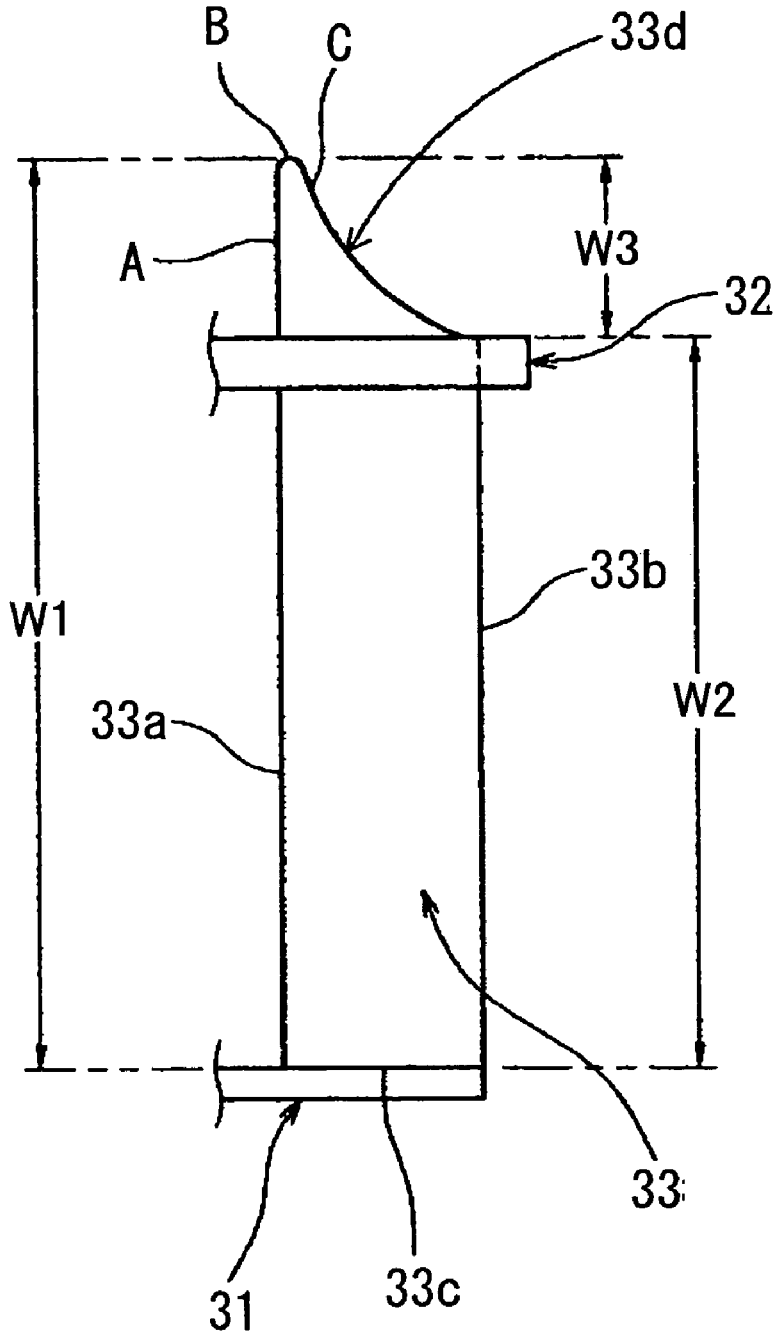
FIG. 4 is a front view that depicts the constitution for all of the vanes of the impeller.

The annular member 32, which is for reinforcement, is mated and fixed to the portion that is the air suction port side end part 33*d* of each of the vanes 33, 33, . . . and that are the air outlet side edge parts 33*b*, 33*b*, . . . , and is integrated with the vanes 33, 33, . . . each of the air outlet side edge parts 33*b*, 33*b*, . . . is the portion of the minimum vane width W2, as shown in FIG. 4.

As depicted in FIG. 1, the fan housing 4 forms an overall scroll structure, and its cross section forms a continuous plurality of arcs each having differing radii. The passageway that forms an air blow out port 41 of the fan housing 4 is shaped extending from an arcuate surface positioned on the most downstream side of the scroll portion and tangential to a prescribed air blow out direction, and its radii are substantially equal.

A recessed part 7*a* is formed in the bell mouth 7. The recessed part 7*a*, having a prescribed depth, has a cross sectional shape suitable for the air suction port side end part (tip portion extending from the annular member 32) 33*d* of each of the tapered vanes 33, 33, . . . , as depicted in FIG. 4., to loosely fit rotatably with a small clearance on a level so that a leakage flow is not generated. Specifically, the recessed part 7*a* protrudes upward (in the air flow upstream side direction) from the air suction port forming plate 6, as depicted in FIG. 2. The extent of the protrusion corresponds to the width W3 of the tapered portion of the air suction port side end parts 33*d*, 33*d*, . . . of the vanes 33, 33, . . . . The shape of the tapered portions of the air suction port side end parts 33*d*, 33*d*, . . . having a width W3 and the shape of the recessed part 7*a* are related, as depicted in FIG. 2.

The mutually continuous portion (the boundary portion) between the air suction port forming plate 6 and the bell mouth 7 is provided with a step part 6*a*, as depicted in FIG. 2, whose width (the step) corresponds to the width (the thickness) of the annular member 32. Thereby, the vane width W2 portion from the annular member 32 to the hub 31 corresponds to the widths of the passageways of a vortex chamber 40 and the air blow out port 41 inside the fan housing 4.

As discussed above, the gap between the tapered air suction port side end parts 33*d*, 33*d*, . . . of the vanes 33, 33, . . . and the inner surface of the recessed part 7*a* of the bell mouth 7 of the fan housing 4 is narrowly formed so that it is less than a prescribed value. Consequently, it is possible to suppress the generation of a reverse flow of air in the region close to the air suction port side end part 33*d* of the air outlet side edge part 33*b* of each of the vanes 33, 33, . . . of the impeller 3 without providing the impeller 3 with an annular shroud opposing the annular bell mouth 7. Thereby, the flow speed distribution becomes close to uniform, and the multi-vane centrifugal fan 1 can be operated with little noise.

The following enumerates the features of the multi-vane centrifugal fan according to the first embodiment.

Here, the recessed part 7*a* having a prescribed depth is formed in the bell mouth 7 of the fan housing 4. Because the air suction port side end part 33*d* of each of the vanes 33, 33, . . . of the impeller 3 corresponds to the cross sectional shape of the recessed part 7*a*, the sealing performance is sufficiently high even without a shroud. Thereby, a reverse flow at the vicinity of the air suction port side end part 33*d* of each of the air outlet side edge parts 33*b*, 33*b*, . . . of the vanes 33, 33, . . . is suppressed while having the advantages of a shroudless structure (reduction in the number of parts, weight, and disc friction); consequently, the flow speed distribution over the entire area of the space on the air outlet side of the vanes 33, 33, . . . becomes nearly uniform, and the relative velocity decreases. As a result, the aerodynamic noise decreases.

In addition, because the gap is small between the air suction port side end parts 33*d*, 33*d*, . . . of the vanes 33, 33, . . . and the inner circumferential surface of the recessed part 7*a* of the bell mouth 7, there is little interference, and aerodynamic noise due to interference is also reduced.

Figure 9:
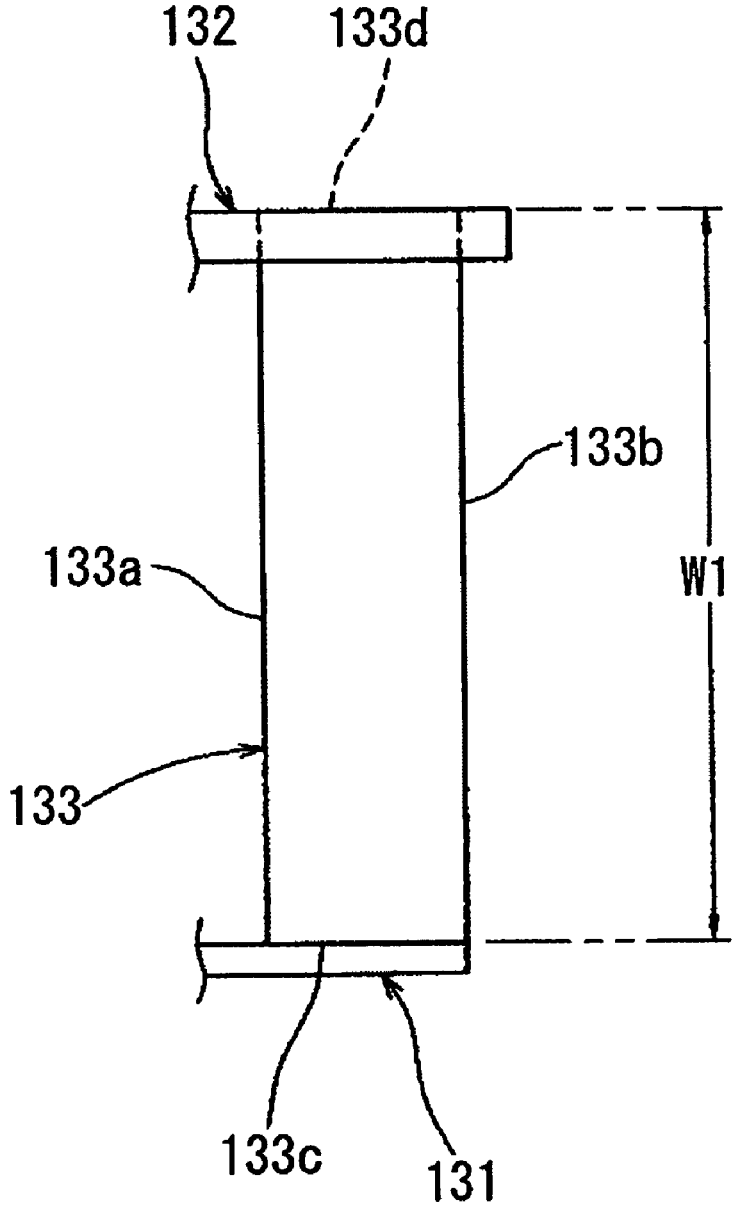
Fig. 9 (Prior Art)
FIG. 9 is a front view that depicts the constitution of all of the vanes of the impeller of a conventional multi-vane centrifugal fan.

In addition, as can be understood by comparing FIG. 4 with FIG. 9, if the shape corresponding to the cross sectional shape of the recessed part 7*a* of the bell mouth 7 and suited to sealing the vanes 33, 33, . . . is formed by, assuming the shape of the vane 133 whose conventional vane width depicted in FIG. 9 is fixed at W1, cutting out part of that air suction port side end part 133*d*, then the weight of the vane 33 decreases by just that portion, the load on the impeller drive motor 2 decreases, and the breaking strength of each of the vanes 33, 33, . . . increases.

In addition, with the multi-vane centrifugal fan 1 according to the first embodiment, the vane width of each of the vanes 33, 33, . . . is constituted so that the air outlet side edge part 33*b* is smaller than the air inlet side edge part 33*a*, and so that it decreases with a pattern that varies with the arcuate shape having a prescribed curvature from the air inlet side edge part 33*a* to the air outlet side edge part 33*b*. Because it is so constituted, a more favorable sealing performance can be achieved in the vicinity of the bell mouth 7.

In addition, because the vane width W1 of the air inlet side edge part 33*a* of each of the vanes 33, 33, . . . is made large while the vane width W2 of the air outlet side edge part 33*b* is made small, the air sucked in from the air suction port 5 into the fan housing 4 can be blown out in the centrifugal direction more smoothly.

Figure 7:
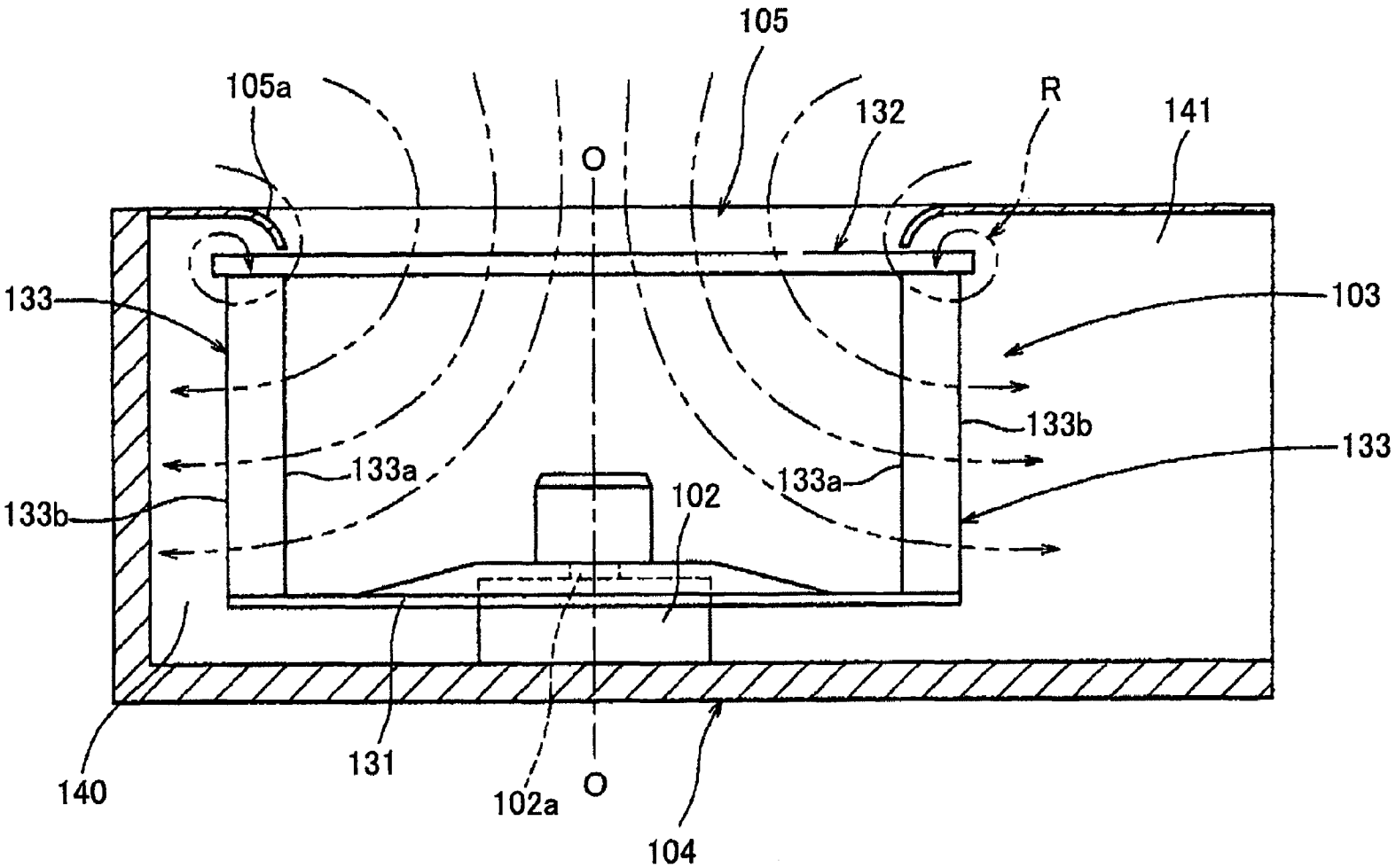
Fig. 7 (Prior Art)
FIG. 7 is a cross sectional view that depicts the constitution of a conventional multi-vane centrifugal fan.
Figure 8:
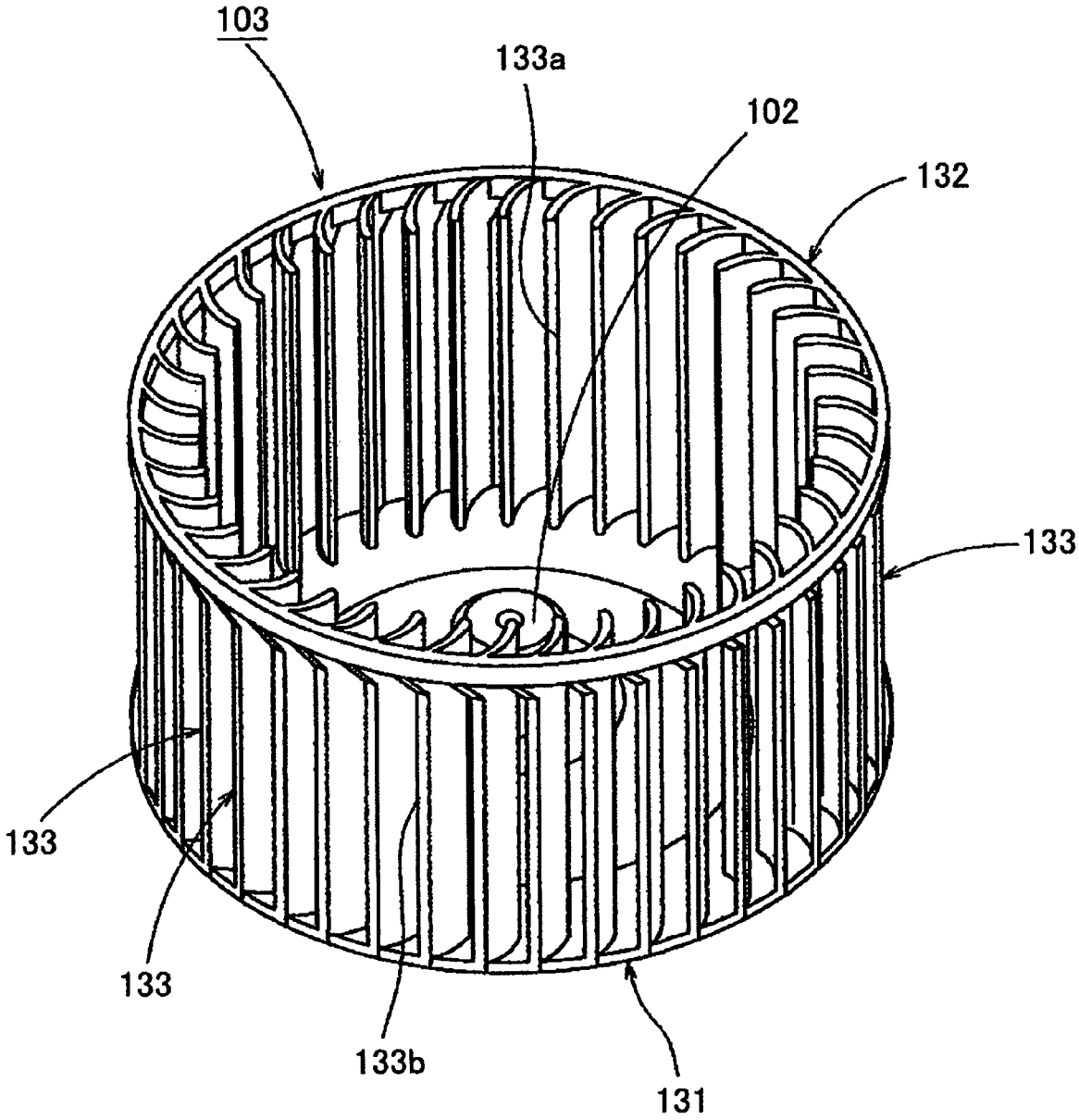
Fig. 8 (Prior Art)
FIG. 8 is an oblique view that depicts the constitution of an impeller of a conventional multi-vane centrifugal fan.

In addition, with the multi-vane centrifugal fan 1 of the first embodiment, the annular member 32 for reinforcement is provided and arranged at the portion that is the air outlet side edge part 33*b*, which is where the vane width of the vane 33 is smallest, and that is the air suction port side end part 33*d*. Because it is so constituted, if the air suction port 5 is disposed toward the upper side as depicted in FIG. 2, then the center of gravity of the impeller 3 shifts downward and its rotational state is more stable compared with the conventional multi-vane centrifugal fan depicted in FIG. 7.

Second Embodiment

Figure 5:
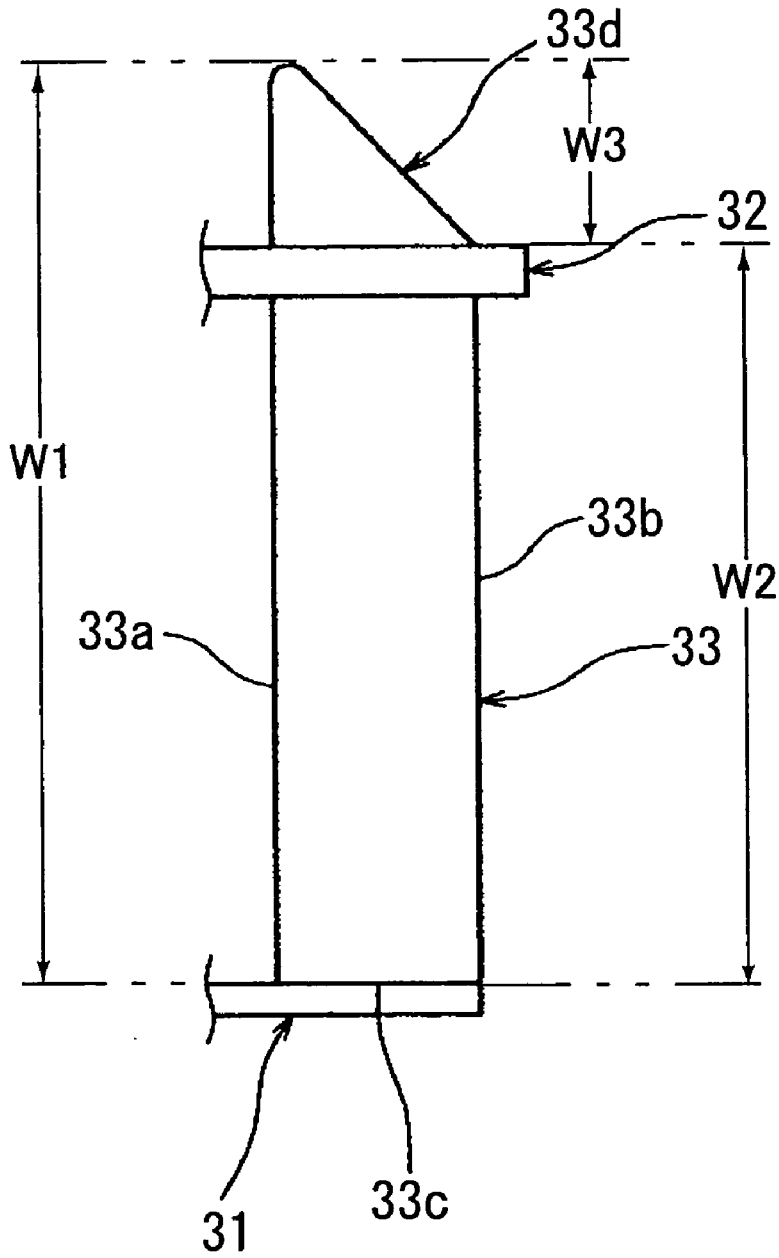
FIG. 5 is a front view that depicts the constitution for all of the vanes of the impeller according to the second embodiment.

FIG. 5 depicts the constitution of the vane portion of the multi-vane centrifugal fan according to the second embodiment of the invention of the present application.

Here, the shape of the notched part of the air suction port side end part 33*d* in the constitution of the abovementioned first embodiment is modified to a shape wherein the vane width from the air inlet side edge part 33*a* to each of the air outlet side edge parts 33*b*, 33*b*, . . . decreases linearly from W1 to W2, as depicted in FIG. 5.

With such a shape as well, the clearance between the air suction port side end parts 33*d*, 33*d*, . . . of the vanes 33, 33, . . . and the recessed part 7*a* of the bell mouth 7 can be reduced, sealing performance can be ensured, and reverse flow can be suppressed; thereby, with this case as well, leakage flow in the vicinity of the bell mouth 7 can be suppressed, and ventilation noise can be reduced.

Third Embodiment

Figure 6:
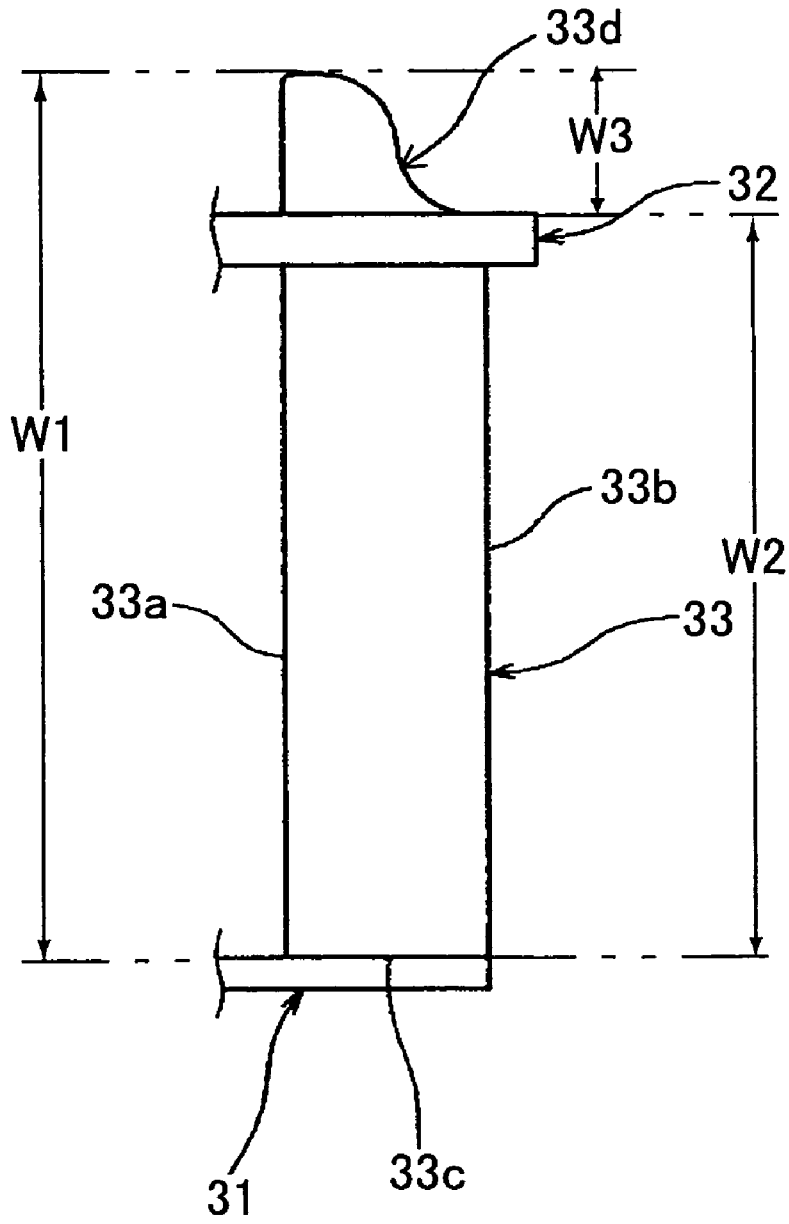
FIG. 6 is a front view that depicts the constitution for all of the vanes of the impeller according to the third embodiment.

FIG. 6 depicts the constitution of the vane portion of the multi-vane centrifugal fan according to the third embodiment of the invention of the present application.

Here, the shape of the notched part of the air suction port side end part 33*d* in the constitution of the abovementioned first embodiment is made to vary by decreasing in a curved shape (more specifically, an S-shaped curve) from the air inlet side edge part 33*a* to each of the air outlet side edge parts 33*b*, 33*b*, . . . , as depicted in FIG. 6.

The notched part of the air suction port side end part 33*d* can be modified to a variety of curved shapes from the air inlet side edge part 33*a* to each of the air outlet side edge parts 33*b*, 33*b*, . . . ; however, if substantially S-shaped as mentioned above, then the entirety of the air suction port side end part 33*d* can particularly be made to correspond to the cross sectional shape of the recessed part 7*a* of the bell mouth 7.

Thus, in this case, because the clearance to the recessed part 7*a* of the bell mouth 7 can be reduced across the entirety of the air suction port side end part 33*d*, sealing performance can be further increased, and reverse flow can be effectively suppressed in the vicinity of the portion that is the air outlet side edge part 33*b* and that is the air suction port side end part 33*d*. In addition, it also becomes more difficult for leakage flow to be generated.

INDUSTRIAL FIELD OF APPLICATION

According to the multi-vane centrifugal fan of the present invention, operating noise can be effectively reduced without reducing fan efficiency.

What is claimed is:

1. A multi-vane centrifugal fan, comprising:

a fan housing having an air suction port forming plate forming an air suction port and a step part, and a bell mouth with a recessed part of a prescribed depth provided around a circumference of the air suction port; and an impeller rotatably housed in the fan housing and including:

a hub rotatably driven around a shaft core, a plurality of vanes fixed to the hub and arranged with a prescribed spacing in a circumferential direction of the hub, and an annular member for reinforcement provided on a side of the vanes opposite the hub, the annular member being accommodated by the step part, the recessed part having air suction port side end parts positioned on the side of the vanes opposite the hub and rotatably inserted in the recessed part without having a shroud.

2. The multi-vane centrifugal fan as recited in claim 1, wherein each of the vanes has a longitudinal width in a shaft core direction that decreases with a prescribed variation pattern from an air inlet side to an air outlet side.

3. The multi-vane centrifugal fan as recited in claim 2, wherein the prescribed variation pattern includes a pattern that changes a shape of the air suction port side end part to a curved shape from the air inlet side to the air outlet side.

4. The multi-vane centrifugal fan as recited in claim 3, wherein the annular member is disposed at the air outlet side of the vanes proximate the air suction port.

5. The multi-vane centrifugal fan as recited in claim 2, wherein the prescribed variation pattern includes a pattern that changes a shape of the air suction port side end part to an arcuate shape having a prescribed curvature from the air inlet side to the air outlet side.

6. The multi-vane centrifugal fan as recited in claim 5, wherein the annular member is disposed at the air outlet side of the vanes proximate the air suction port.

7. The multi-vane centrifugal fan as recited in claim 2, wherein the prescribed variation pattern includes a linear variation pattern in which a shape of the air suction port side end part linearly changes from the air inlet side to the air outlet side.

8. The multi-vane centrifugal fan as recited in claim 7, wherein the annular member is disposed at the air outlet side of the vanes proximate the air suction port.

9. The multi-vane centrifugal fan as recited in claim 2, wherein the annular member is disposed at the air outlet side of the vanes proximate the numerous vanes proximate the air suction port.

10. A multi-vane centrifugal fan, comprising:

a fan housing having an air suction port and a bell mouth with a recessed part of a prescribed depth provided around a circumference of the air suction port, the fan housing forming a vortex chamber and an air blow out port passageway; and an impeller rotatably housed in the fan housing and including:

a hub rotatably driven around a shaft core, a plurality of vanes fixed to the hub and arranged with a prescribed spacing in a circumferential direction of the hub, the prescribed spacing being fully open in a shaft core direction and in a direction of a side of the vanes opposite the hub, and an annular member for reinforcement disposed on an outer side in a radial direction of the vanes and integrated with a plurality of end parts on the side of the vanes opposite the hub, the annular member being aligned with a surface of the vortex chamber passageway or the air blow out port passageway, the recessed part having air suction port side end parts positioned on the side of the vanes opposite the hub and inserted in the recessed part.

* * * * *